US010359255B2

(12) United States Patent
Ibarguren

(10) Patent No.: US 10,359,255 B2
(45) Date of Patent: Jul. 23, 2019

(54) MUZZLE-LOADING FIREARM WITH IMPROVED GAS SEALING

(71) Applicant: BLACKPOWDER PRODUCTS, INC., Lawrenceville, GA (US)

(72) Inventor: Inigo Lizarralde Ibarguren, Bergara (ES)

(73) Assignee: BLACKPOWDER PRODUCTS, INC., Lawrenceville, GA (US)

( * ) Notice: Subject to any disclaimer, the term of this patent is extended or adjusted under 35 U.S.C. 154(b) by 0 days.

(21) Appl. No.: 16/022,625

(22) Filed: Jun. 28, 2018

(65) Prior Publication Data

US 2019/0003801 A1 Jan. 3, 2019

Related U.S. Application Data

(60) Provisional application No. 62/525,968, filed on Jun. 28, 2017.

(51) Int. Cl.
*F41C 9/08* (2006.01)

(52) U.S. Cl.
CPC ..... *F41C 9/08* (2013.01)

(58) Field of Classification Search
CPC .... F41C 9/08; F41A 3/64; F41A 19/57; F41A 21/12
See application file for complete search history.

(56) References Cited

U.S. PATENT DOCUMENTS 4,715,139 A * 12/1987 Rodney, Jr. ..... F41C 9/08 42/51
5,408,776 A * 4/1995 Mahn ..... F41C 9/08 42/51
5,915,934 A * 6/1999 Knight ..... F41A 3/18 42/51
6,189,253 B1 2/2001 Knight et al.
6,226,916 B1 * 5/2001 Kendall ..... F41C 9/08 42/51
6,647,653 B1 * 11/2003 Hengstenberg ..... F41C 9/08 42/51
6,996,930 B2 * 2/2006 Hengstenberg ..... F41A 19/57 42/51
7,076,902 B2 * 7/2006 Hengstenberg ..... F41C 9/08 42/51
D555,749 S 11/2007 Epp
8,468,731 B2 6/2013 Phair
9,500,437 B2 * 11/2016 Grazioplene ..... F41C 9/08
9,739,553 B1 * 8/2017 Gibbons, III ..... F41A 11/02
2002/0035800 A1 3/2002 Lewis

* cited by examiner

*Primary Examiner* — Joshua T Semick

(74) *Attorney, Agent, or Firm* — Gardner Groff Greenwald & Villanueva, PC

(57) ABSTRACT

A muzzle-loading rifle for use with a primer of the type having a shell and a piston fitted within the shell and adapted for igniting gunpowder in the rifle to fire a bullet. The rifle includes a barrel and a breech plug having an opening for receiving the primer and connected to the barrel. A movable bolt is fitted within the rifle for movement toward the breech plug and adjacent the primer. A spring-loaded primer sealing device is mounted to the movable bolt for engaging the shell of the primer and for pressing against it to help seal the end of the movable bolt to the shell of the primer to control the travel of gases and residue. The spring-loaded primer sealing device is mounted to the movable bolt for engaging the shell of the primer only and does not engage against the piston portion of the primer.

12 Claims, 6 Drawing Sheets

MUZZLE-LOADING FIREARM WITH IMPROVED GAS SEALING

CROSS-REFERENCE TO RELATED APPLICATION

This application claims the benefit of U.S. Provisional Patent Application Ser. No. 62/525,968 filed Jun. 28, 2017, the entirety of which is hereby incorporated herein by reference for all purposes.

TECHNICAL FIELD

The invention relates to a muzzle-loading rifle (also known as muzzleloader), i.e. a rifle in which the gunpowder and bullet are loaded and pressed into the barrel manually. More particularly, the invention has to do with sealing in the area of the breech plug, bolt and receiver to control the flow of gas.

BACKGROUND

A muzzle-loading rifle is a rifle that, in structural and functional terms, replicates old-fashioned, traditional rifles and gives the user the feeling that they are firing an antique weapon in accordance with classical hunting techniques. Specifically, a muzzle-loading rifle is mainly characterized in that the gunpowder and the bullet must be manually inserted into the bottom of the barrel and pressed down before the shot can be fired.

After the gunpowder and the bullet have been pressed into the bottom of the barrel (next to the breech plug), the trigger is pulled, the shot happening as follows: the pulling of the trigger causes an ignition at the end of the breech plug opposite the gunpowder and the bullet. The ignition travels through a relatively narrow internal conduit of the breech plug until it reaches the other side of the breech plug, reaching the gunpowder. The gunpowder then explodes, causing the bullet to be expelled.

Typically, gases and residue from ignition and the explosion of the gun powder can travel within the rifle to areas that one would rather the gases didn't travel. In one example, the gases can cause fouling of close-tolerance components. For example, after a certain number of shots is performed using these rifles, traces of gunpowder usually collect in the connection area between the breech plug and the barrel (a connection area that is generally threaded although it may present other arrangements). These traces of gunpowder can make it very difficult to detach the breech plug from the barrel.

Furthermore, depending on the particular igniter (e.g. primer) and its fit with the breech plug (and its engagement with a movable bolt of the rifle), ignition of the primer typically causes a substantial amount of fouling, for example, wherein sparks and hot gasses pass by the engagement with the movable bolt and cause fouling of the same. In most cases, the escape of hot gasses and sparks from the ignition is substantially inconsistent, which affects the ignition of the gunpowder, and thus the velocity and trajectory of the bullet are inconsistent. According to some examples, after the gunpowder explodes, pressure "backwashes" from the barrel and travels along the same pathway as the hot gasses and sparks of the primer igniting, thereby causing further fouling of the bolt and receiver.

Thus, there is a need for a means for controlling the flow (travel) of gases and residue within the rifle. It is to the provision of such that the present invention is primarily directed.

SUMMARY OF THE INVENTION

In example embodiments, the present invention relates to a muzzle-loading firearm with an improved gas seal. Generally speaking, the breeching system of the firearm preferably spring loads the rim of the primer to keep it seated tightly in the breech plug during the pressures of ignition.

In one example form, the invention relates to a muzzle-loading rifle for use with a primer of the type having a shell and a piston fitted within the shell and adapted for igniting gunpowder in the rifle to fire a bullet. Preferably, the rifle includes a barrel and a breech plug having an opening for receiving the primer and connected to the barrel. A movable bolt is fitted within the rifle for movement toward the breech plug and adjacent the primer. A spring-loaded primer sealing device is mounted to the movable bolt for engaging the shell of the primer and for pressing against it to help seal the end of the movable bolt to the shell of the primer to control the travel of gases and residue.

Preferably, the spring-loaded primer sealing device is mounted to the movable bolt for engaging the shell of the primer only and not engaging against the piston portion of the primer.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

BRIEF DESCRIPTION OF THE DRAWINGS

The drawing figures show aspects and features of a muzzle-loading firearm with an improved gas seal according to example embodiments of the invention.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
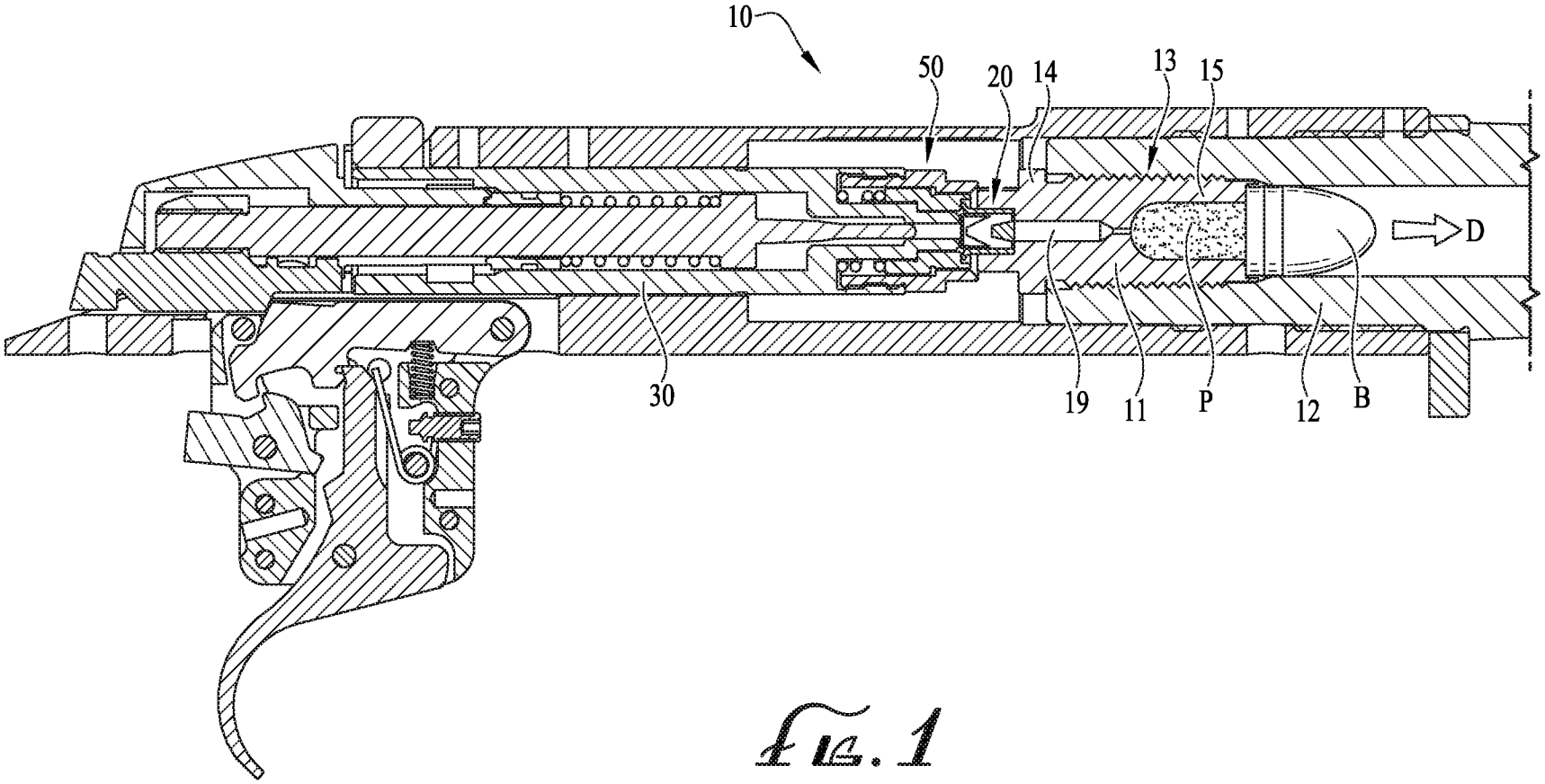
FIG. 1 is a cross-sectional view of a muzzle-loading rifle according to an example form of the invention, in particular showing the area of the rifle in which the breech plug is located inside the barrel.

FIG. 1 shows a cross-section of a conventional muzzle-loading rifle 10, in particular the area of the rifle in which the breech plug 11 is located inside the barrel 12. In the rifle shown in the figure the breech plug 11 is fixed to the barrel 12 by means of a threaded connection area 13. The breech plug 11 comprises a first end 14 and a second end 15. A bullet B can be housed inside the barrel 12 in front of a certain amount of gunpowder or other powder charge P, as is well known in the art.

In the rifle shown in the figure the shot occurs as follows. Firstly, an ignition occurs in the chamber in the first end 14 of the breech plug 11, for example by an igniter or primer 20. Said ignition travels along an internal conduit 19 of the breech plug 11 until it reaches the second end 15 of the breech plug 11. When the ignition reaches the gunpowder P, an explosion occurs, causing the bullet B to be fired in the shot direction D.

Referring to FIGS. 1-4, the invention relates to a muzzle-loading rifle 10 for use with a primer 20 of the type having a shell 21 with an integral anvil 23 and a piston 22 fitted within the shell 21 and adapted for igniting gunpowder P in the rifle 10 to fire a bullet. In alternate example embodiments as will be described below, the primer 20 can take on various other forms. A firing pin 31 movably fitted within the bolt 30 strikes the primer 20, in particular striking the piston 22 and driving it against the anvil 23, causing ignition. The breech plug 11 has an opening or receiver 16 in the form of a central bore formed in the first end 14 thereof for receiving the primer 20. A movable bolt 30 is fitted within the rifle for movement toward the breech plug 11 and adjacent the primer 20.

Figure 2A:
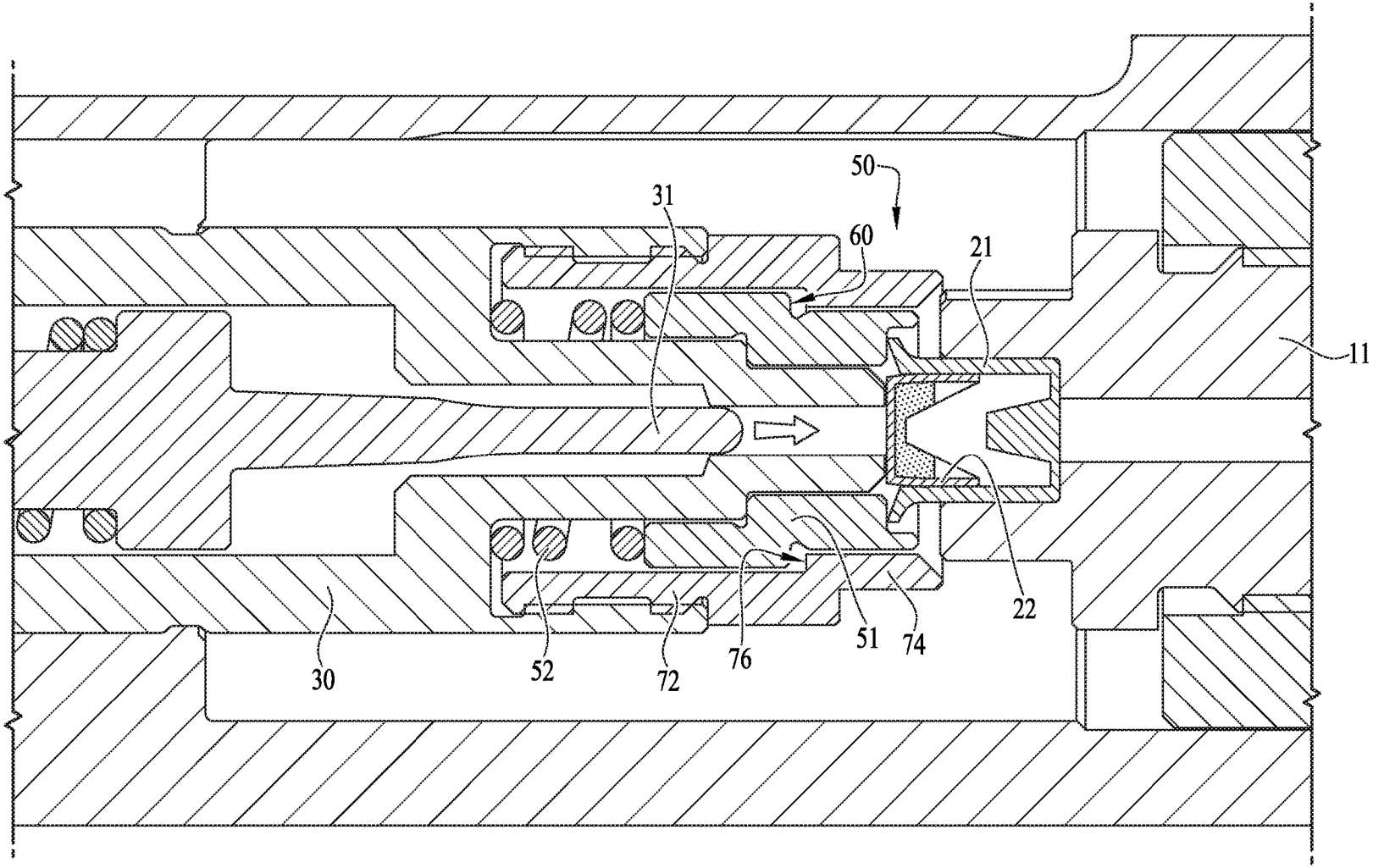
FIG. 2A is a cross-sectional view of a portion of the rifle of FIG. 1.

In example embodiments and as depicted in FIG. 2A, a spring-loaded primer sealing device 50 is mounted to the movable bolt 30 for engaging the shell 21 of the primer 20 and for pressing against it to help seal the end of the movable bolt 30 to the shell 21 of the primer 20 to control the travel of gases and residue. In this regard, the spring-loaded primer sealing device 50 provides an annular seal against the primer shell 21.

Figure 3:
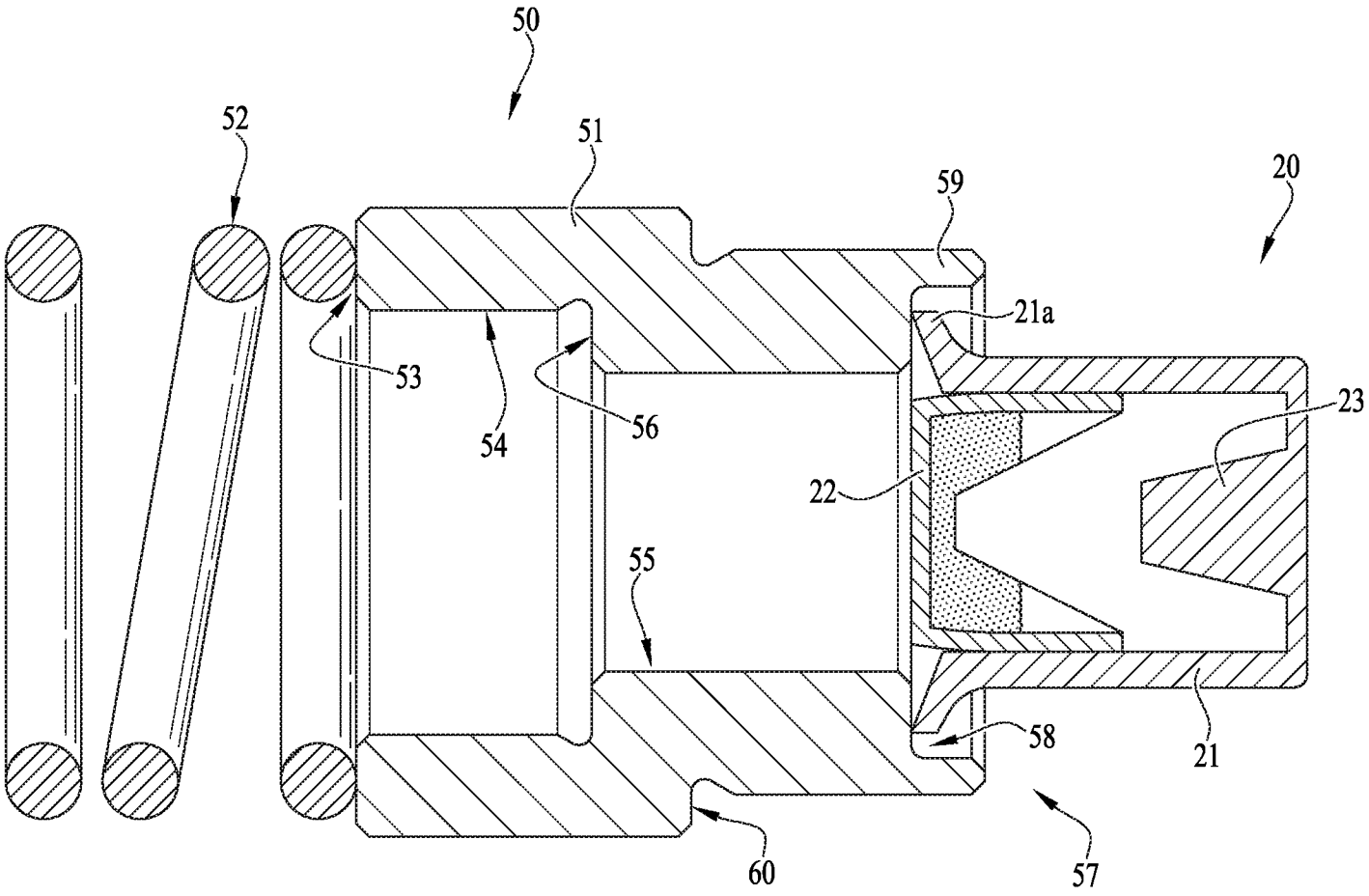
FIG. 3 is an enlarged cross-sectional view of some of the components depicted in FIG. 2A and in particular showing the spring-loaded primer sealing device, with some components of the rifle omitted for clarity of illustration.

As depicted in FIGS. 2A and 3, the spring-loaded primer sealing device 50 includes a stepped cylindrical inner sleeve or chassis or carriage 51 which is biased toward the breech plug 11 by a coil spring 52. In example embodiments, one end of the coil spring 52 engages a first end 53 of the spring-loaded primer sealing device 50 and an opposite end of the coil spring 52 engages a portion of the bolt 30. In example embodiments, the inner bore of the inner sleeve 51 is stepped to closely match the stepped diameters of the bolt 30. Thus, the inner sleeve 51 has first bore 54, second bore 55, and an inner shoulder 56 formed therebetween. In this regard, the inner sleeve 51 is closely, but movably, mounted over the movable bolt 30.

The second end 57 of the spring-loaded primer sealing device 50 includes an annular shoulder 58, an axially extending outer lip 59, and an outer rim 60 laterally offset from the annular shoulder 58. The annular shoulder 58, as urged toward the primer shell 21, seals against an outer rim 21*a* of the primer shell 21. Preferably, the spring-loaded primer sealing device 50 is mounted to the movable bolt 30 and adapted for engaging only the shell 21 of the primer 20 and not engaging against the piston portion 22 of the primer 20. In example embodiments, the annular shoulder 58 comprises a diameter that is at least partially larger than the outer rim 21*a* of the primer shell 21. According to some example embodiments, the outer rim 21*a* can extend generally perpendicularly relative to the extension of the primer shell 21. Thus, according to some example embodiments, when the outer rim 21*a* extends at about 90 degrees relative to the extension of the primer shell 21, the annular shoulder 58 can engage and form a seal with the entirety of the primer shell 21 surface that is exposed and aligned with the annular shoulder 58.

Figure 4:
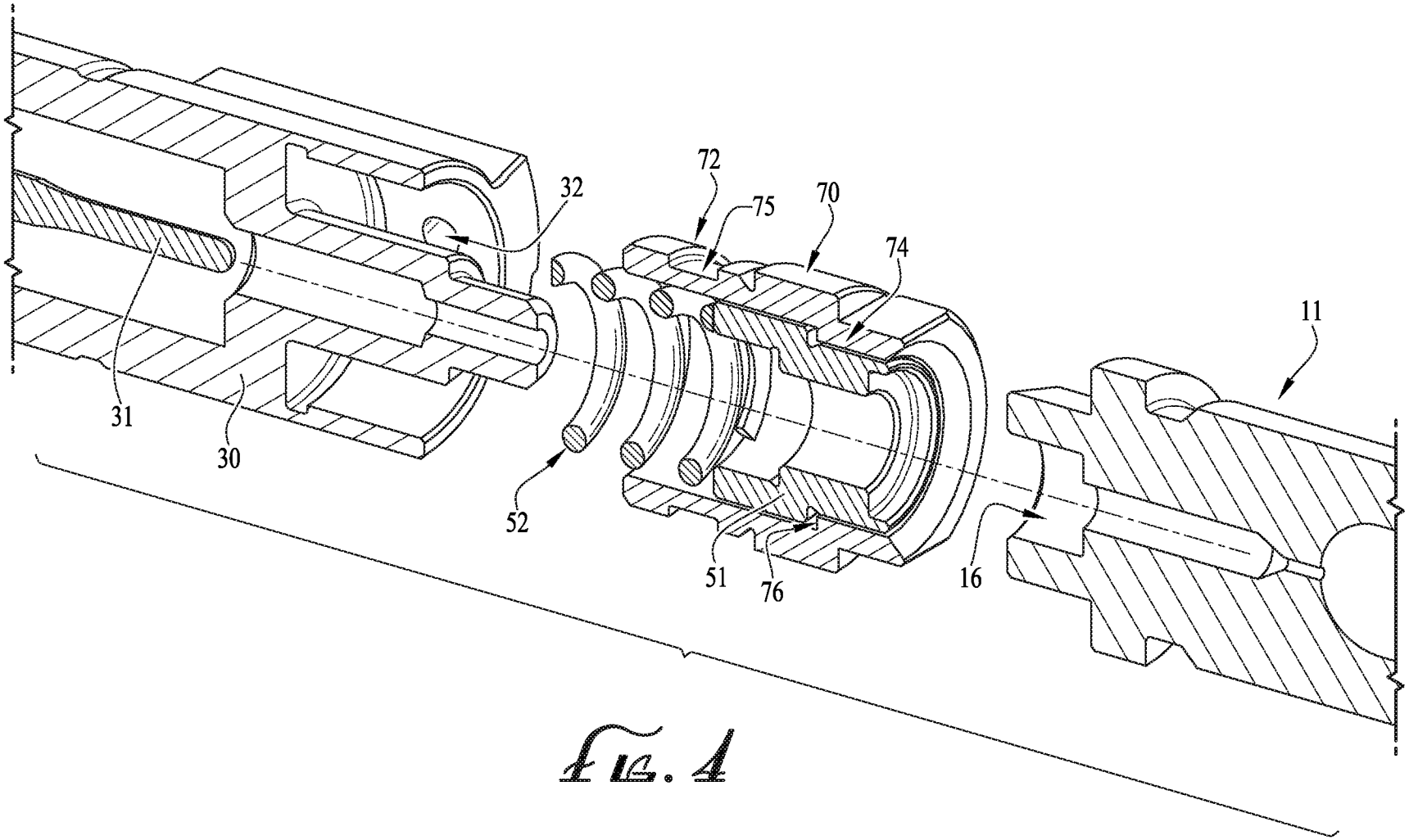
FIG. 4 is an enlarged perspective exploded view of part of the muzzle-loading rifle depicted in FIG. 2A and in particular showing the spring-loaded primer sealing device.

In example embodiments and as depicted in FIG. 4, an outer sleeve 70 mounts to the bolt 30 and houses the inner sleeve 51 and coil spring 52 therein. For example, one or more holes or fastener receivers 32 are provided for receiving a fastener that is further engaged with an outer groove or ring 75 of the outer sleeve 70. Extension of a fastener or bolt through the receiver 32 and against the groove 75 preferably mounts the outer sleeve 70 to the bolt 30. In example embodiments, the outer sleeve 70 comprises a first end 72 that is fixedly mounted to the bolt 30 and a second end 74 comprising a stepped inner bore for retaining the inner sleeve 51 and coil spring 52. An annular shoulder 76 of the inner bore near the second end 74 is configured for engagement with the outer rim 60 of the inner sleeve 51, for example, due to the coil spring 52 biasing the inner sleeve 51 thereagainst. Thus, in a relaxed and biased position, the inner sleeve 51 is biased such that the outer rim 60 is pressed against the annular shoulder 76.

Figure 2B:
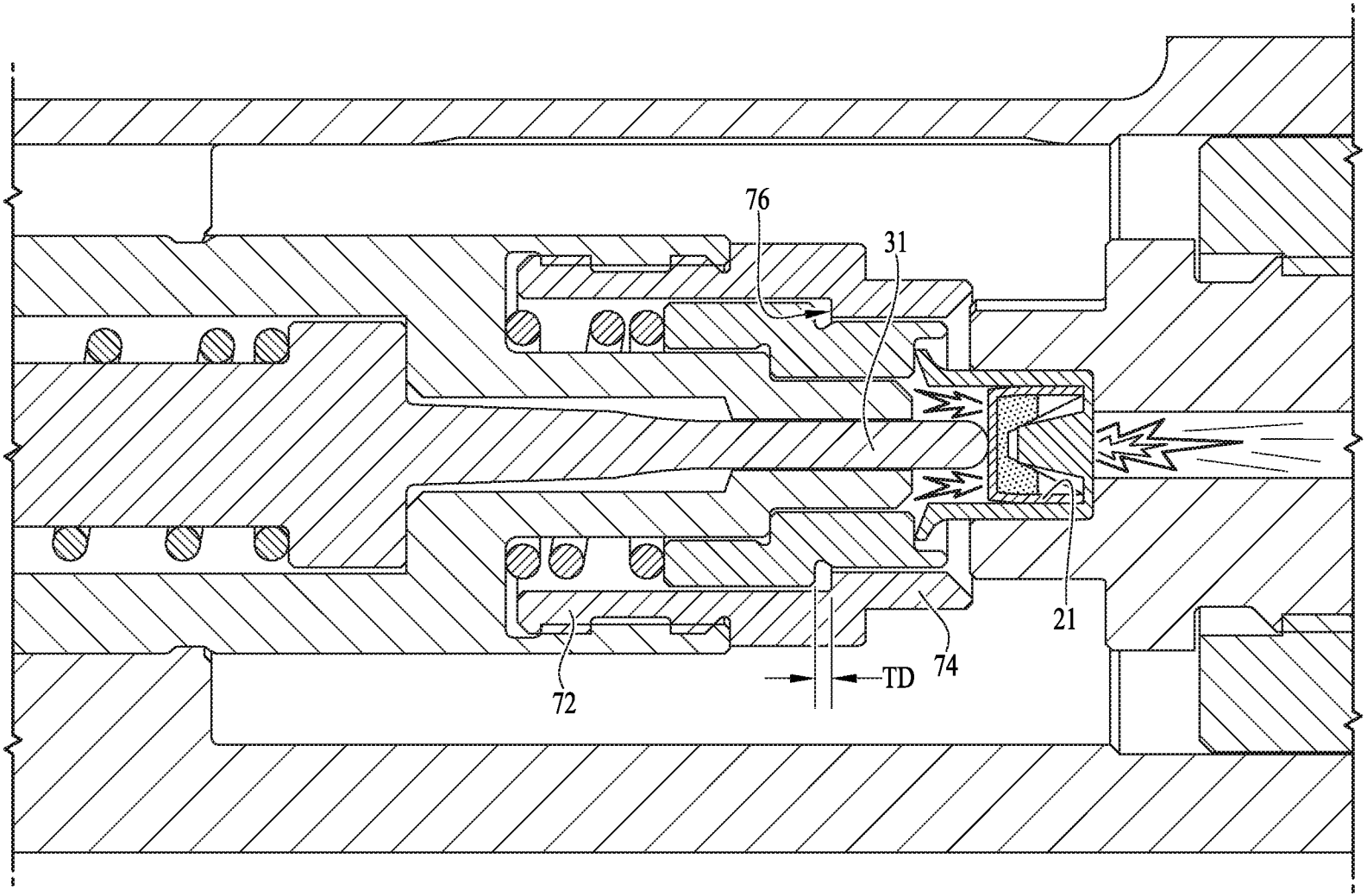
FIG. 2B is a cross-sectional view of a portion of the rifle of FIG. 2A, in particular showing the firing pin of the rifle striking the primer to cause an ignition.

When the bolt 30 is moved forward, the annular shoulder 58 becomes engaged with the outer rim 21*a* of the primer shell 21, and further compresses the coil spring 52 until the bolt 30 is locked in its forward-most position (see FIG. 2A). Thus, the coil spring 52 forcibly biases the inner sleeve 51 against the outer rim 21*a* of the primer shell 21 so as to provide a substantial seal such that gasses and residue (generated by both the ignition of the primer P and the explosion of the gunpowder P) are prevented from passing thereby. Accordingly, sparks and hot gasses and other residue from the ignition of the primer are substantially, if not entirely, prevented from passing by the seal defined between the annular shoulder 58 and the primer shell 21. For example, as depicted in FIG. 2B, the firing pin 31 (movably fitted within the bolt 30) strikes the primer 20, causing ignition thereof, and both heat and sparks (see illustrated ignition) from the ignition of the primer pass along the internal conduit 19 of the breech plug 11 until it reaches the second end 15 of the breech plug 11. As described above, exposure of the heat and sparks with the gunpowder P causes an explosion to occur, causing the bullet B to be fired in the shot direction D. Preferably, as depicted, the seal provided between the annular shoulder 58 and the outer rim 21*a* causes the entirety of the explosion of primer ignition (e.g., heat, sparks, gasses and residue) to travel along the internal conduit 19.

According to example embodiments, by providing a seal between the bolt and the primer (e.g., annular shoulder 58 and outer rim 21*a* according to one example embodiment), the ignition of the primer and the resulting heat and sparks (and gasses) provided thereby are much more consistent, for example, as the seal between the annular should 58 and outer rim 21*a* causes the entirety of the primer ignition (e.g., heat, sparks and gasses) to travel through the internal conduit towards the gunpowder P. Thus, the seal preferably prevents any heat, sparks and gasses from the ignition from leaking such that they are not used for igniting the gunpowder P. Accordingly, by providing a seal between the bolt and the primer, a substantial amount (or about the entirety) of the heat, gasses and sparks from the primer igniting travels through the internal conduit 19 of the breech plug 11 to ignite the gunpowder P. In example embodiments, by providing the seal such that the heat, sparks and gasses of the primer ignition travel through the internal conduit 19 (and not fouling the bolt and receiver), a much more consistent amount of heat and sparks are provided to ignite the gunpowder P. Accordingly, by providing a consistent ignition, ignition of the gunpowder P is consistent, thereby substantially increasing the accuracy and reliability of the muzzle-loading rifle 10. Furthermore, consistent ignition of the gunpowder additionally causes the bullet to have a substantially consistent velocity and trajectory.

Furthermore, after the explosion of the gunpowder P, any "backwash" of pressure caused by the explosion of gunpowder P is similarly prevented from passing by the seal defined between the annular shoulder 58 and outer rim 21*a*. Thus, in addition to preventing fouling from ignition of the primer, the seal preferably prevents any gasses or sparks from the explosion of the gunpowder P from passing thereby so as to eliminate any fouling occurring near the breech, the bolt and the receiver.

In example embodiments, the spring-loaded primer sealing device 50 preferably provides for sealing engagement with primers of various sizes. For example, as the tolerances and dimensions of a primer of one brand or manufacturer can be different from a primer of another brand or manufacturer, the present spring-loaded primer sealing device 50 is preferably universal in that regardless of the primer dimensions or geometry, a substantial seal is provided between the annular shoulder 58 and the outer rim 21*a* to prevent gasses and residue from passing by the seal.

Figure 5:
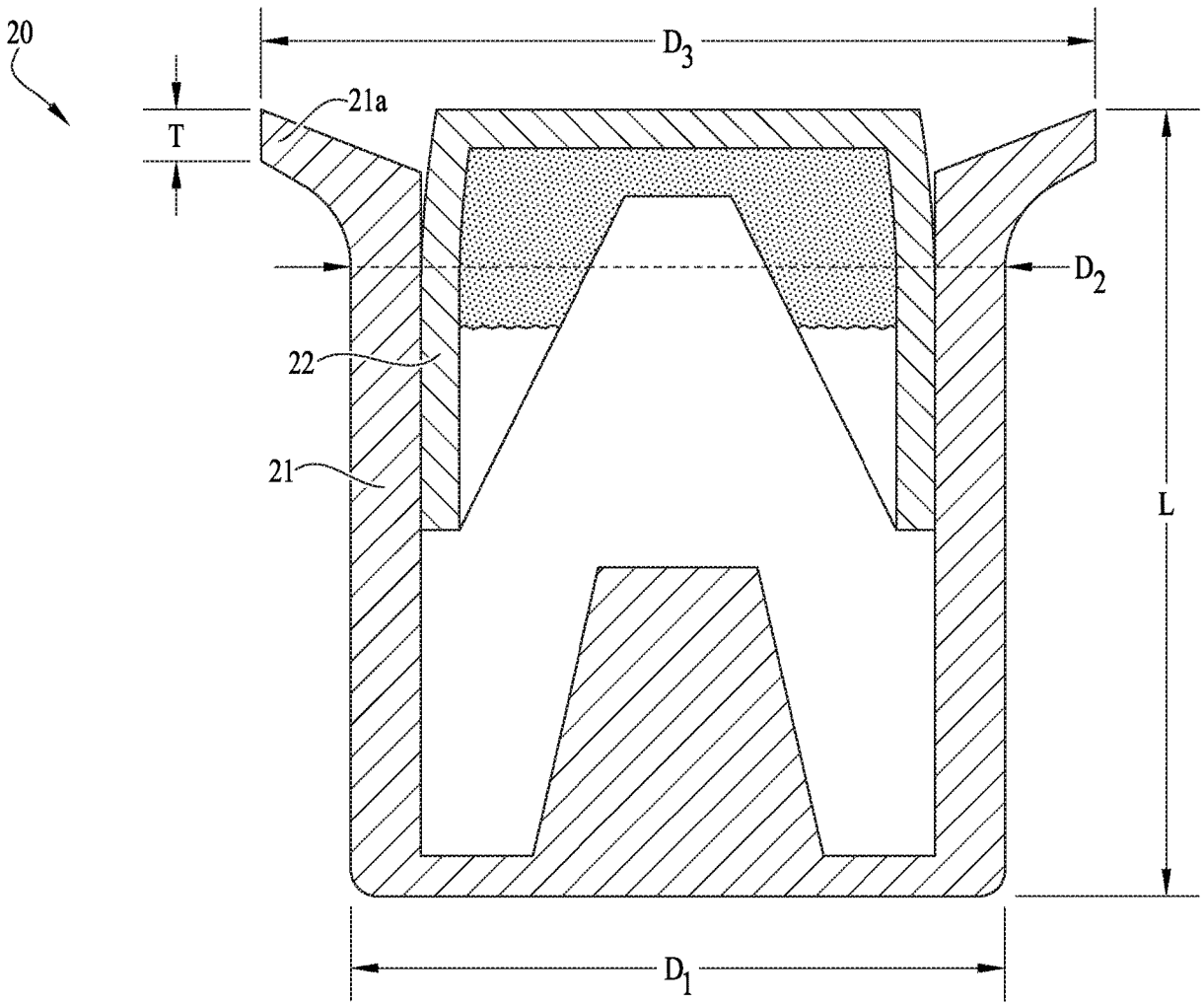
FIG. 5 is a perspective view of an example primer that can be used with the muzzle-loading rifle depicted in FIG. 1.

As depicted in FIG. 5, the primer shell 21 comprises a first outer diameter D1 and a second outer diameter D2, the outer rim 21*a* comprises an outer diameter D3 and a thickness T, and a length L is defined between an end of the shell 21 and the outer rim 21*a*. In example embodiments, the first outer diameter D1 is generally between 0.23-0.30 inches, more preferably between about 0.236-0.280 inches according to one example embodiment. The second outer diameter D2 is generally between about 0.23-0.25 inches, more preferably between about 0.240-0.244 inches according to one example embodiment. The outer diameter D3 is generally between about 0.25-0.35 inches, more preferably between about 0.305-0.310 inches according to one example embodiment. The thickness of the rim 21*a* is generally between about 0.01-0.045 inches, more preferably between about 0.020-0.030 inches according to one example embodiment. And the length L is generally between about 0.250-0.350, more preferably between about 0.290-0.305 inches according to one example embodiment.

Accordingly, according to example embodiments of the present invention, regardless of the specific dimensions of the primer 20, the spring-loaded primer sealing device 50 is preferably capable of substantially pressing against the outer rim 21*a* of the primer 20 so as to provide a sufficient seal and prevent gasses and residue from passing thereby. Referring back to FIG. 2A, the inner sleeve 51 is permitted to travel or move up to about 0.040 inches (see TD), for example about 0.028 inches according to one example embodiment of the present invention. Thus, from the neutral position when the coil spring 52 is biasing the inner sleeve 51 (with the outer rim 60 engaged with the annular shoulder 76 of the outer sleeve 70), the inner sleeve 51 can retract (while compressing the coil spring 52) to define a travel distance TD up to about 0.040 inches, for example, so as to maintain a seal against the outer rim 21*a* regardless of the specific dimensions of the primer 20.

According to example embodiments of the present invention, the spring 52 that is provided for biasing the inner sleeve 51 is such that between about 15-80 pounds of force can be applied against the primer shell when the bolt is in the loaded and locked position with the primer being received in the receiver of the breech plug. According to one example embodiment, between about 15-50 pounds of force is applied against the primer shell, for example, between about 25-45 pounds according to one example embodiment. Optionally, one or a combination of springs or other biasing members can be provided so as to provide a desirable amount of force against the primer shell when the primer shell is received in the receiver of the breech plug.

According to another example embodiment of the present invention, various other priming or igniting devices can be used to ignite the gunpowder P. According to one example embodiment, a shell member that is generally similarly shaped to the primer shell 21 can be used with a rifle primer, for example, wherein the two are connected together with a loading tool and similarly inserted in the receiver 16 of the breech plug 11. As described above, the dimensions of the shell member are generally similar to the dimensions of the primer shell 21 as described above. According to one example embodiment, the first outer diameter D1 is generally between 0.23-0.30 inches, more preferably about 0.279 inches according to one example embodiment. The outer diameter D3 is generally between about 0.25-0.45 inches, more preferably about 0.344 inches according to one example embodiment. The thickness of the rim 21*a* is generally between about 0.01-0.055 inches, more preferably about 0.044 inches according to one example embodiment. And the length L is generally between about 0.250-0.350, more preferably about 0.299 inches according to one example embodiment.

Preferably, the shell member dimensions are such that the annular shoulder 58 and outer rim (e.g., of the shell member) are engageable and capable of making a substantial seal therebetween. According to some example embodiments, the shell member comprises a stainless steel material. In some example embodiments, the shell member is reusable, for example, wherein the rifle primer (after ignition) can be removed from a receiver of the shell member and a new rifle primer can be inserted.

According to another example embodiment of the present invention, various other springs, biasing members, seals, gaskets, grommets, etc. so as to provide a spring-loaded bolt or primer sealing device, for example, so as to cause the face of the bolt to be biased or spring loaded against the primer that is within the receiver of the breech plug. According to the depicted example embodiment, the spring 52 is a coil spring. According to other example embodiments, the spring 52 can comprise a Belleville spring washer, or for example, an o-ring, a deformable or resilient washer or ring, or other biasing device.

In alternate example embodiments, the breech plug can comprise one or more biased or spring-loaded portions, for example, so as to cause a similar sealing effect with the bolt. For example, according to one example embodiment, a least a portion of the breech plug is at least partially movable and/or spring-loaded so as to provide the primer shell with a seal against the bolt face. According to some example embodiments, the breech plug comprises at least two components, and the at least two components are at least partially movable and/or biased with respect to each other. According to one example embodiment, an o-ring, resilient washer or other biasing member can be provided with the breech plug (e.g., to provide a spring-loaded breech plug) so as to allow for the primer shell to substantially seal with the bolt head. According to yet another example embodiment, the bolt can comprise the spring-loaded primer sealing device and the breech plug can also be spring-loaded.

While the invention has been described with reference to example embodiments, it will be understood by those skilled in the art that a variety of modifications, additions and deletions are within the scope of the invention, as defined by the following claims.

What is claimed is:

1. A muzzle-loading rifle for use with a primer of the type having a shell and a piston fitted within the shell and adapted for igniting gunpowder in the rifle to fire a bullet, the rifle comprising:

a barrel;

a breech plug having an opening for receiving the primer and being connected to the barrel;

a movable bolt fitted within the rifle for movement toward the breech plug and adjacent the primer; and a spring-loaded primer sealing device mounted to the movable bolt for engaging the shell of the primer and for pressing against the shell to help seal the end of the movable bolt to the shell of the primer to control the travel of gases and residue.

2. A muzzle-loading rifle as claimed in claim 1 wherein the spring-loaded primer sealing device is mounted to the movable bolt for engaging the shell of the primer only and does not engage against the piston portion of the primer.

3. A muzzle-loading rifle as claimed in claim 1 wherein the spring-loaded primer sealing device includes an inner sleeve movably fitted to an end of the movable bolt.

4. A muzzle-loading rifle as claimed in claim 3 wherein the spring-loaded primer sealing device further includes an outer sleeve movably fitted over the inner sleeve in a concentric manner.

5. A muzzle-loading rifle as claimed in claim 4 wherein a spring presses against the inner sleeve, the inner sleeve being at least partially movable along the outer sleeve.

6. A muzzle-loading rifle for use with a primer of the type having a shell and a piston fitted within the shell and adapted for igniting gunpowder in the rifle to fire a bullet, the rifle comprising:

a barrel;

a breech plug having an opening for receiving the primer and being connected to the barrel;

a movable bolt fitted within the rifle for movement toward the breech plug and adjacent the primer; and a spring-loaded, sleeve-like primer sealing device movably mounted to the movable bolt for engaging a rim portion of the shell of the primer and for pressing against the shell to help seal the end of the movable bolt to the shell of the primer to control the travel of gases and residue.

7. A muzzle-loading rifle as claimed in claim 6 wherein the spring-loaded primer sealing device is mounted to the movable bolt for engaging the shell of the primer only and does not engage against the piston portion of the primer.

8. A muzzle-loading rifle as claimed in claim 6 further comprising an outer sleeve movably fitted over the sleeve-like primer sealing device in a concentric manner.

9. A spring-loaded primer sealing device positioned at an end of a movable bolt for a firearm for use with a primer of the type having a shell and a piston fitted within the shell, the spring-loaded primer sealing device comprising:

an inner sleeve;

a biasing member; and an outer sleeve, the outer sleeve movably fitted over the inner sleeve, the inner sleeve being generally axially aligned with the biasing member such that the inner sleeve is biased in one direction relative to the outer sleeve, wherein the inner sleeve is configured for engaging and pressing against the shell of the primer such that the end of the movable bolt seals therewith.

10. A muzzle-loading rifle as claimed in claim 1 wherein the spring-loaded primer sealing device is independently movable relative to the movable bolt.

11. A muzzle-loading rifle for use with a primer of the type having a shell and a piston fitted within the shell and adapted for igniting gunpowder in the rifle to fire a bullet, the rifle comprising:

a barrel;

a breech plug having an opening for receiving the primer;

a movable bolt fitted within the rifle for movement toward the breech plug and primer; and a spring-loaded primer sealing device mounted to the movable bolt, the spring-loaded primer sealing device configured for engaging and pressing against the shell of the primer, the spring-loaded primer sealing device configured for sealing the end of the movable bolt to the shell of the primer so as to prevent gasses of the gunpowder ignition from backwashing into undesired components of the rifle.

12. A muzzle-loading rifle as claimed in claim 11 wherein the spring-loaded primer sealing device is independently movable relative to the movable bolt.

* * * * *